US006607417B2

(12) United States Patent
Chen

(10) Patent No.: US 6,607,417 B2
(45) Date of Patent: Aug. 19, 2003

(54) SUCTION DEVICE USED IN AGING PROCESS OF A MICROWAVE TUBE

(75) Inventor: Han-Ying Chen, Chupei (TW)

(73) Assignee: Air Asia Technology Inc., Tainan Hsien (TW)

( * ) Notice: Subject to any disclaimer, the term of this patent is extended or adjusted under 35 U.S.C. 154(b) by 21 days.

(21) Appl. No.: 09/992,938

(22) Filed: Nov. 5, 2001

(65) Prior Publication Data

US 2003/0087579 A1 May 8, 2003

(51) Int. Cl.[7] ..... H01J 9/38

(52) U.S. Cl. ..... 445/73; 445/41; 445/38; 445/53

(58) Field of Search ..... 445/73, 38, 53, 445/40, 41, 55, 57

(56) References Cited

U.S. PATENT DOCUMENTS 4,861,902 A * 8/1989 Haubrich et al. ..... 549/499
5,537,005 A * 7/1996 Goebel et al. ..... 315/111.81
5,655,886 A * 8/1997 Alderson ..... 417/49
6,114,808 A * 9/2000 Takahashi ..... 315/3.5
6,372,084 B2 * 4/2002 Hongo et al. ..... 118/723 ME

FOREIGN PATENT DOCUMENTS

JP 04098732 * 3/1992 ..... 445/73
JP 04359839 * 12/1992 ..... 315/5.38

* cited by examiner

*Primary Examiner*—Dean A. Reichard
*Assistant Examiner*—Angel R. Estrada
(74) *Attorney, Agent, or Firm*—William E. Pelton, Esq.

(57) ABSTRACT

A suction device used in aging process of a microwave tube includes an ion pump and a suction unit respectively connected to an electron gun and a collector located in two opposite ends of the microwave tube. The suction unit includes a barrel communicated with the microwave tube and a getter disposed in the barrel. An electric power source is electrically connected to the getter. Before operation, the microwave tube along with the suction device undergo exhaust process on a heating exhaust station. After that, the electric power source supplies an electric current to electrify and heat the getter to its activation condition. Therefore, the suction device can greatly save the vacuum suction time of the aging process and the cost associated with the production of the microwave tube.

7 Claims, 7 Drawing Sheets

SUCTION DEVICE USED IN AGING PROCESS OF A MICROWAVE TUBE

BACKGROUND OF THE INVENTION

1. Field of the Invention

The present invention relates to a suction device used in the production of a microwave tube, and more particular to a suction device that can greatly save the vacuum suction time of aging process and therefore reduces the cost associated with the production of a microwave tube.

2. Description of the Related Art

With reference to FIG. 11, a conventional suction device used in aging process of a microwave tube (70) includes two ion pumps (71 and 72) respectively connected to two distal ends of the microwave tube (70). In an aging process of the production, the ion pumps (71 and 72) suck air from the microwave tube (70) until the pressure in the microwave tube (70) reaches less than $10^{-9}$ Torr to create a substantial vacuum state. However with the today's technical standard, the sucking procedure mentioned is time-consuming and therefore results in a high cost associated with the production of the microwave tube (70). Taking the typical 2 liters/sec capacity of the ion pumps (71 and 72) as an example, the aging process time under the specified conditions is as following:

1. DC aging (0%~11% duty): at least 70 hours;
2. RF aging (0%~11% duty): at least 150 hours; and
3. RF aging (11% duty): 50 hours.

Theoretically, if the ion pumps (71 and 72) are adapted to have a higher capacity (>2 liters/sec), the aging process time can be reduced. However ion pumps having high capacity are still very bulky and massive. In addition to these practical drawbacks in operation, they also increase production cost of the microwave tubes.

Accordingly, the present invention tends to provide a suction device used in the aging process of a microwave tube to mitigate or obviate the aforementioned problems.

SUMMARY OF THE INVENTION

The objective of the present invention is to provide a suction device used in the production of a microwave tube to save the aging process time and the cost associated with the production of the microwave tube. The suction device has an ion pump connected to an electron gun and a suction unit connected to a collector, wherein the electron gun and the suction unit are located in opposite ends of the microwave tube. The suction unit has a barrel communicated with the microwave tube, and a getter disposed inside the barrel and electrically connected to an electric power source in order to absorb air in the microwave tube.

Other objectives, advantages and novel features of the invention will become more apparent from the following detailed description when taken in conjunction with the accompanying drawings.

DETAILED DESCRIPTION OF THE PREFERRED EMBODIMENT

Figure 11:
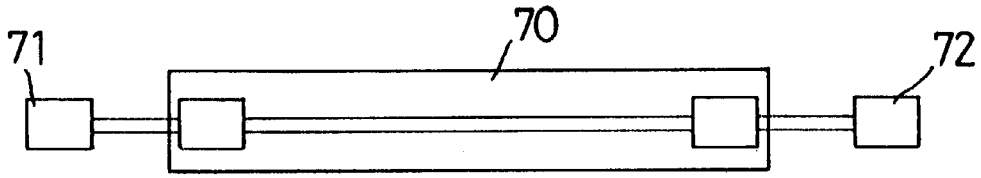
FIG. 11 PRIOR ART
FIG. 11 is a schematic view showing a conventional suction device used in the aging process of the microwave tube.
Figure 1:
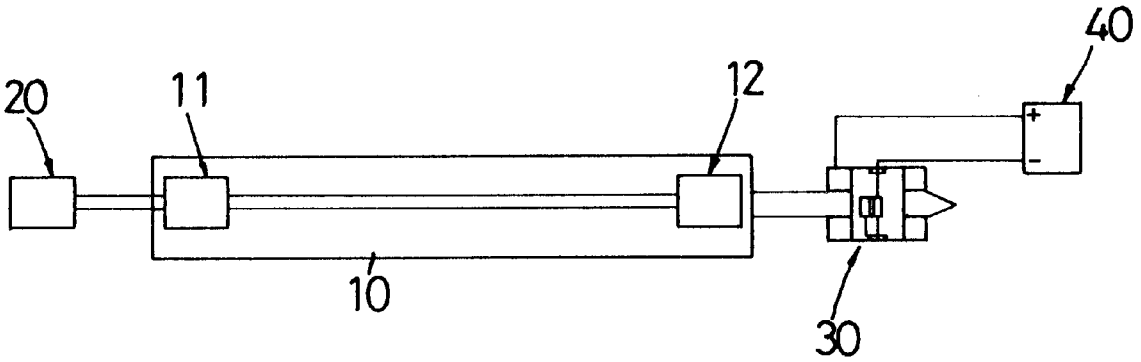
FIG. 1 is a schematic view showing a suction device used in aging process of a microwave tube in accordance with the present invention.

With reference to FIG. 1, a suction device used in aging process of a microwave tube includes a microwave tube (10), an ion pump (20) connected to an end of the microwave tube (10), a suction unit (30) connected to the other end of the microwave tube (10).

The microwave tube (10) has a hollow interior, and an electron gun (11) is located in the hollow interior and close to the ion pump (20). A collector (12) is also located in the hollow interior and close to the suction unit (30).

The ion pump (20) is a conventional apparatus and therefore a detailed description related to its structure is omitted.

The suction unit (30) is connected to the collector (12) so as to suck air inside the hollow interior of the microwave tube (10) via the collector (12). An electric power source (40) is further connected to the suction unit (30) for supplying the electricity required to operate the suction unit (30).

Figure 2:
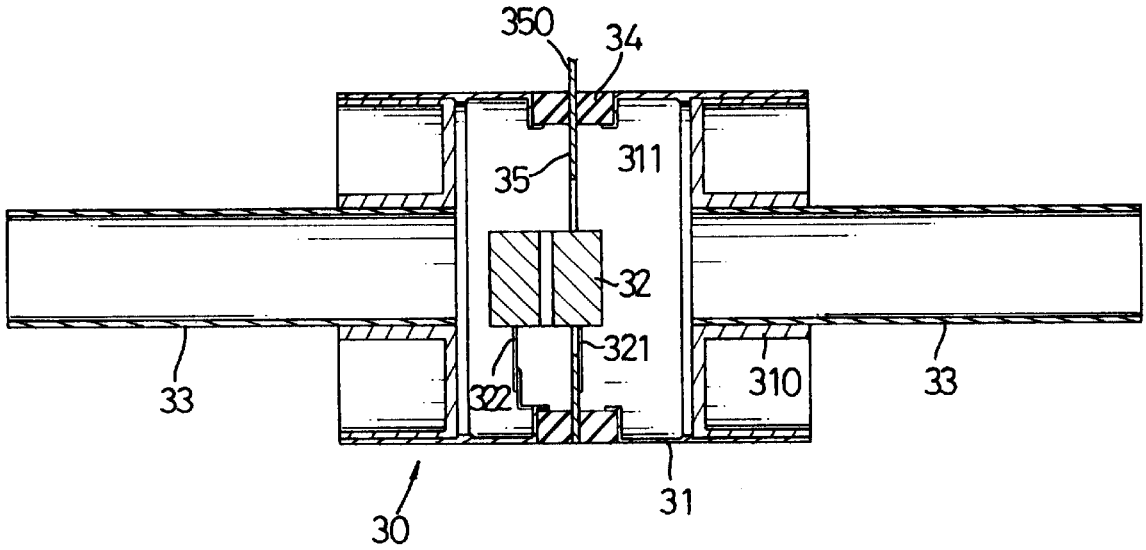
FIG. 2 is a cross-sectional view of a suction unit of the suction device in FIG. 1.

With reference to FIG. 2, the detailed structure of the suction unit (30) includes a barrel (31) composed of kovar (alloy of iron, nickel and cobalt), and a getter (32) having two electrodes (321 and 322).

The barrel (31) has two ends each formed as a connecting portion (310) to be connected respectively to two pipes (33), and one of the pipes (33) further connects to the collector (12) in the microwave tube (10). A chamber (311) is defined in a middle section of the barrel (31). Two insulating rings (34) composed of ceramics are disposed in the chamber (311). A conducting ring (35) is clamped between the insulating rings (34), and having an inner edge extending into the chamber (311) and an outer edge extending out of the barrel (31) to form an electric terminal (350).

The getter (32) electrically connects to the conducting ring (35) and the barrel (31) via the electrodes (321 and 322), and aligns with the pipes (33). Therefore, referring to FIG. 1, when the electric power source (40) supplies an electric current to the getter (32), the temperature of the getter (32) rises.

Figure 3:
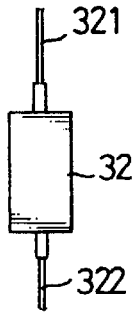
FIG. 3 is another preferred embodiment of a configuration of a getter of the sucking unit.

It should be appreciated that besides the configuration shown in FIGS. 1 and 2, other configurations of the getter (32) can also be adapted. Accordingly, another exemplary configuration of the getter (32) is shown in FIG. 3.

Figure 4:
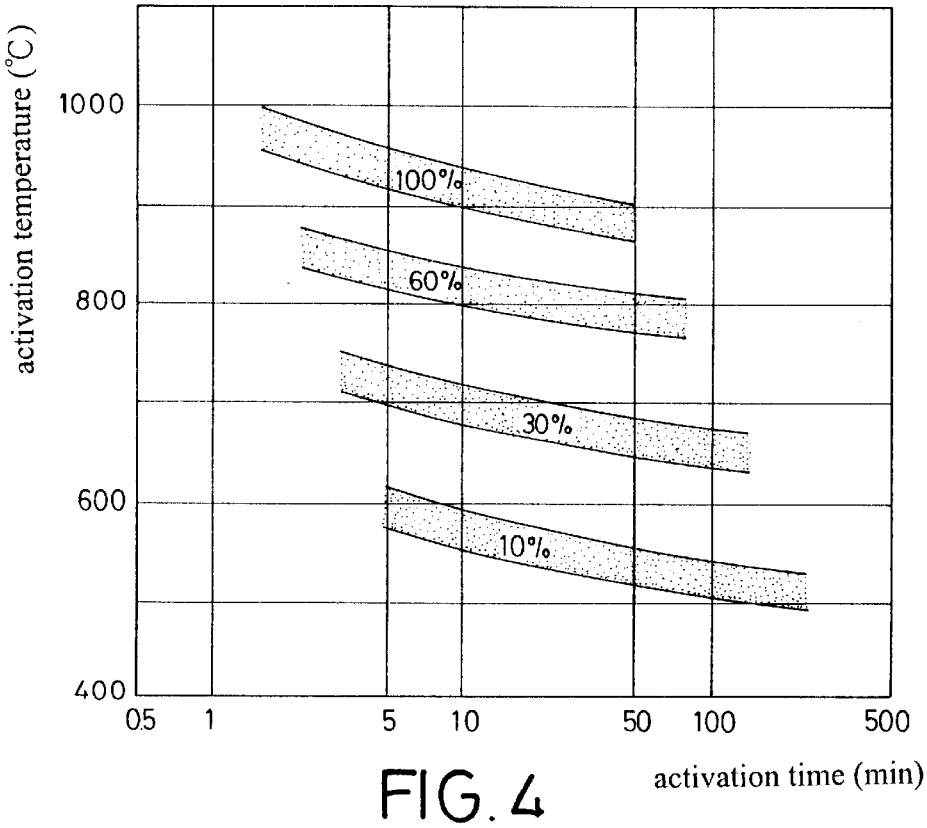
FIG. 4 is a graph showing the activation temperature vs. the activation time of the getter.

Furthermore, the getter (32) is a composition of graphite and zirconium, and has the characteristics of porosity, nonevaporability and high activation temperature. When heated to an ideal temperature, the getter (32) can be fully activated to create a high air absorbability. To take the ST171/HI/9.5–7.5/250° C. type getter as an illustrative example, the activation condition is 900° C. and lasts at least 10 minutes, that is, when the getter is electrified to 900° C., its related properties are explained as following:

With reference to FIG. 4, the activation temperature vs. the activation time of the getter is shown. It is noted that only 10% of the getter has been activated when the temperature reaches 600° C. With the rising of the temperature, the percentage of the getter that has been activated also increases. The getter becomes completely activated when it has been at 900° C. for at least 10 minutes. Thus taking the exhaust condition of 500° C. and 10 hours into account, the ST171 type getter still keeps over 90% of its absorbability after the exhaust process.

Figure 5:
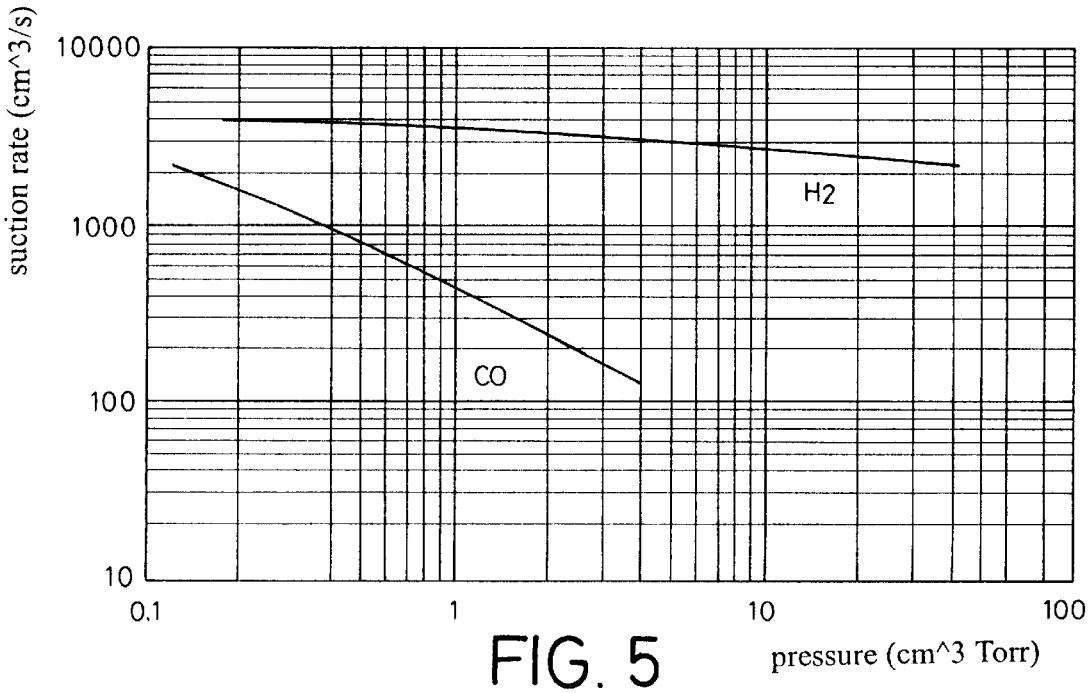
FIG. 5 is a graph showing the suction rate vs. the pressure of CO and $H_2$ under 25° C.
Figure 6:
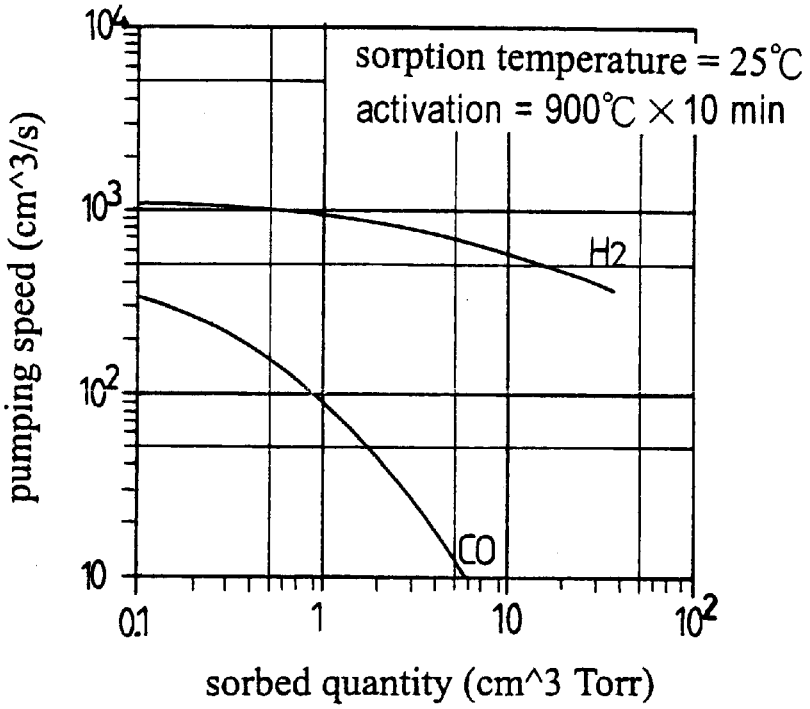
FIG. 6 is a graph showing sorption curves for the getter at 25° C.
Figure 7:
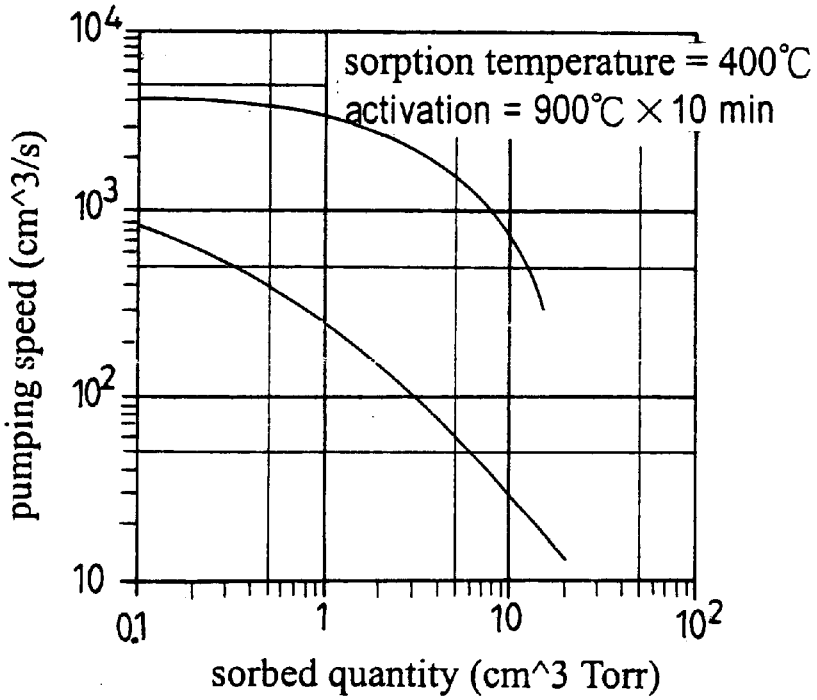
FIG. 7 is a graph showing sorption curves for the getter at 400° C.

The reason to choose the ST171 type getter is that it is low cost and has the high air absorbability. With reference to FIG. 5, the CO and $H_2$ absorbability of the ST171/HI/9.5–7.5/250° C. type getter is shown to illustrate its mentioned high air absorbability. The absorbability of ST171 type getter becomes several times higher at elevated temperature than will be at room temperature, as shown in FIGS. 6 and 7.

Figure 8:
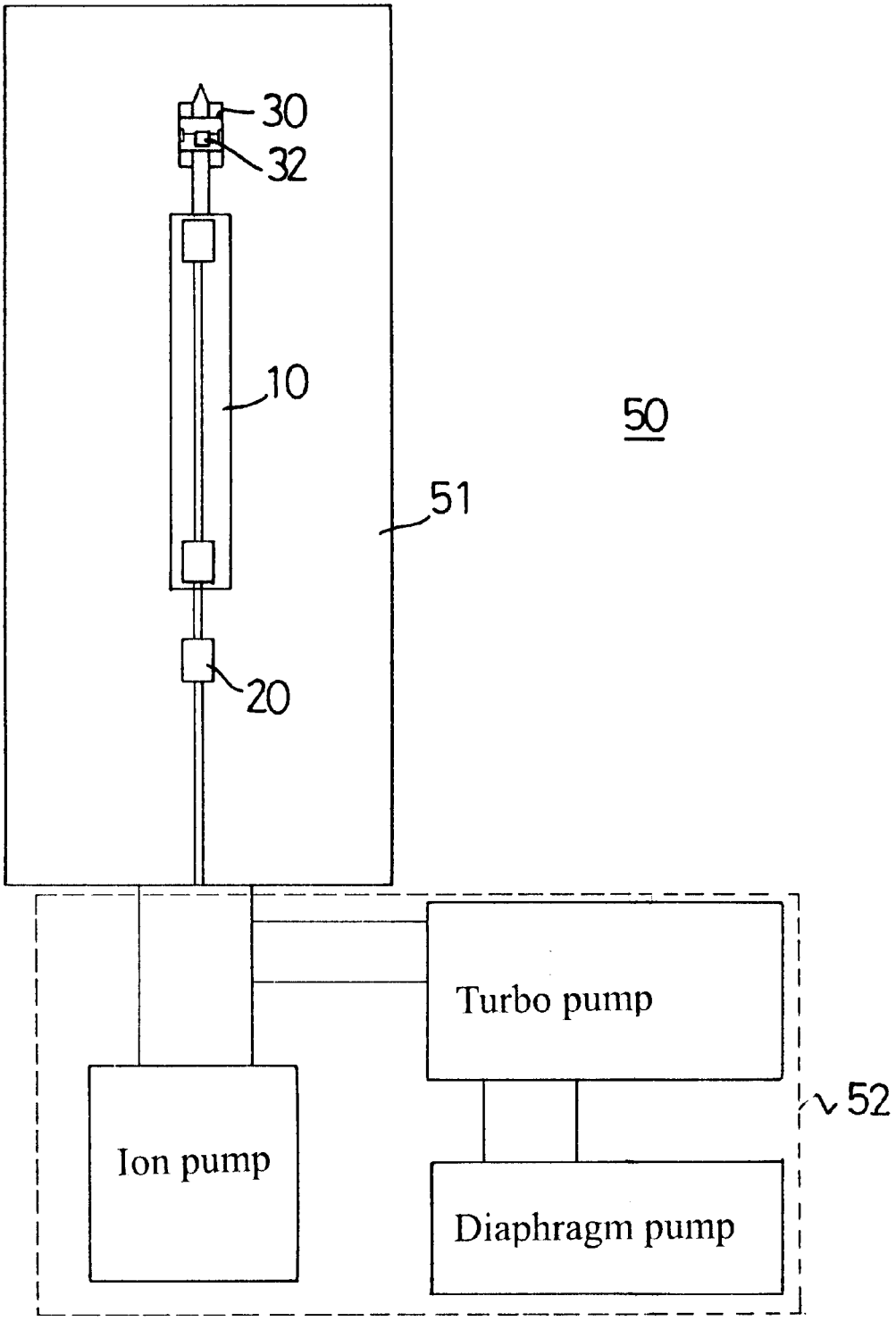
FIG. 8 is a schematic view of the microwave tube disposed on a heating exhaust station.

The procedures related to exhaust process and aging process are described and explained as following:

Firstly, with reference to FIG. 8, the microwave tube (10) is disposed onto a heating exhaust station (50) which includes a cover (51) for receiving the microwave tube (10), and a vacuum suction system (52) connected to the ion pump (20).

Secondly, the microwave tube (10) received in the cover (51) is gradually heated to 500° C. and remains at 500° C. for at least 10 hours. When the pressure in the microwave tube (10) reaches $10^{-7}$–$10^{-8}$ Torr, the microwave tube (10) is allowed to cool, and when the microwave tube (10) is cooled down to room temperature, the getter (32) is then prepared to activate.

Figure 9:
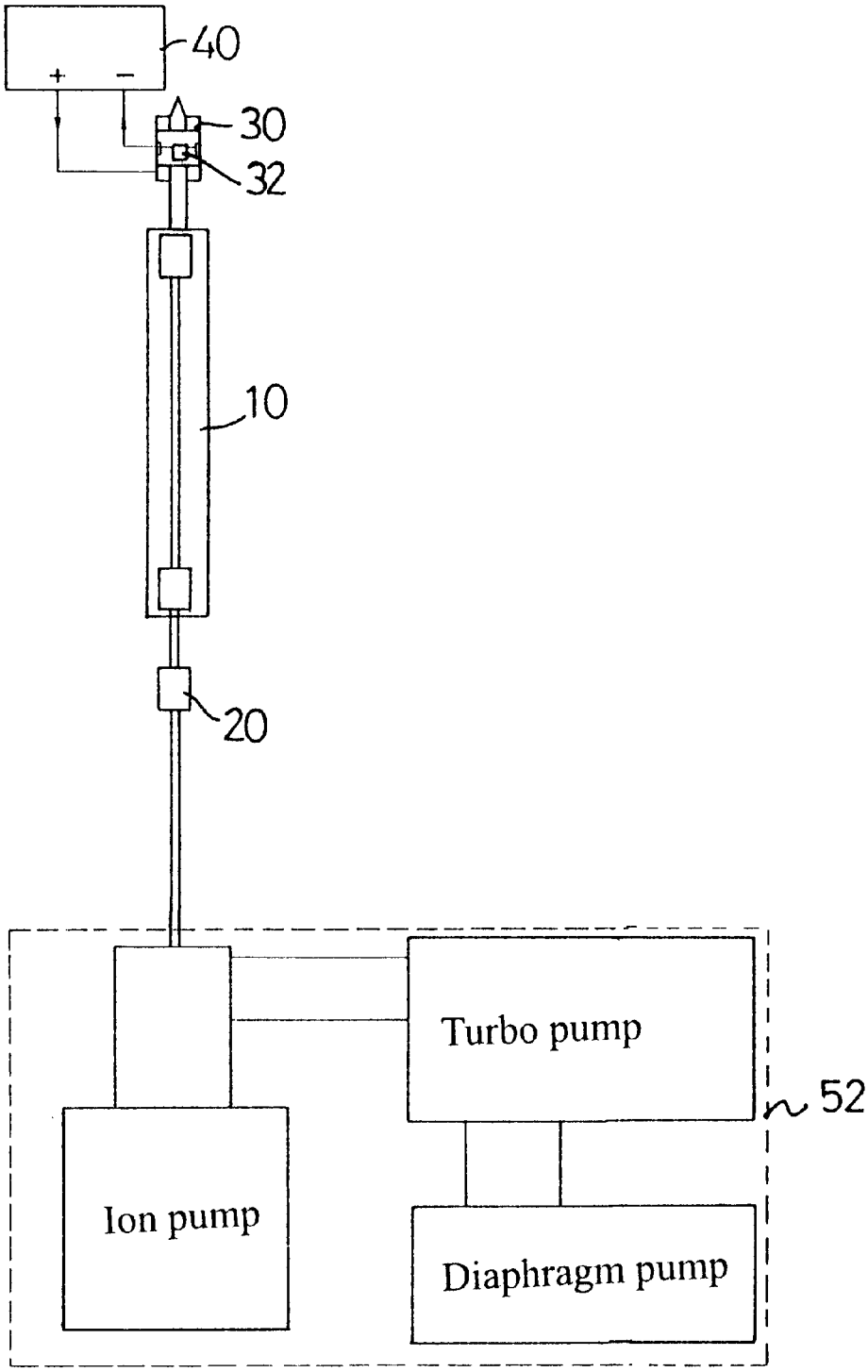
FIG. 9 is another schematic view of the microwave tube disposed on the heating exhaust station.

Thirdly, with reference to FIG. 9, the electric power source (40) supplies the electric current to electrify and to heat the getter (32) so that the getter (32) is heated to 900° C. and remain at 900° C. for at least 10 minutes to fully activate the getter (32). Then the vacuum suction system (52) of the heating exhaust station (50) is used to suck air liberated during the activation of the getter (32).

Figure 10:
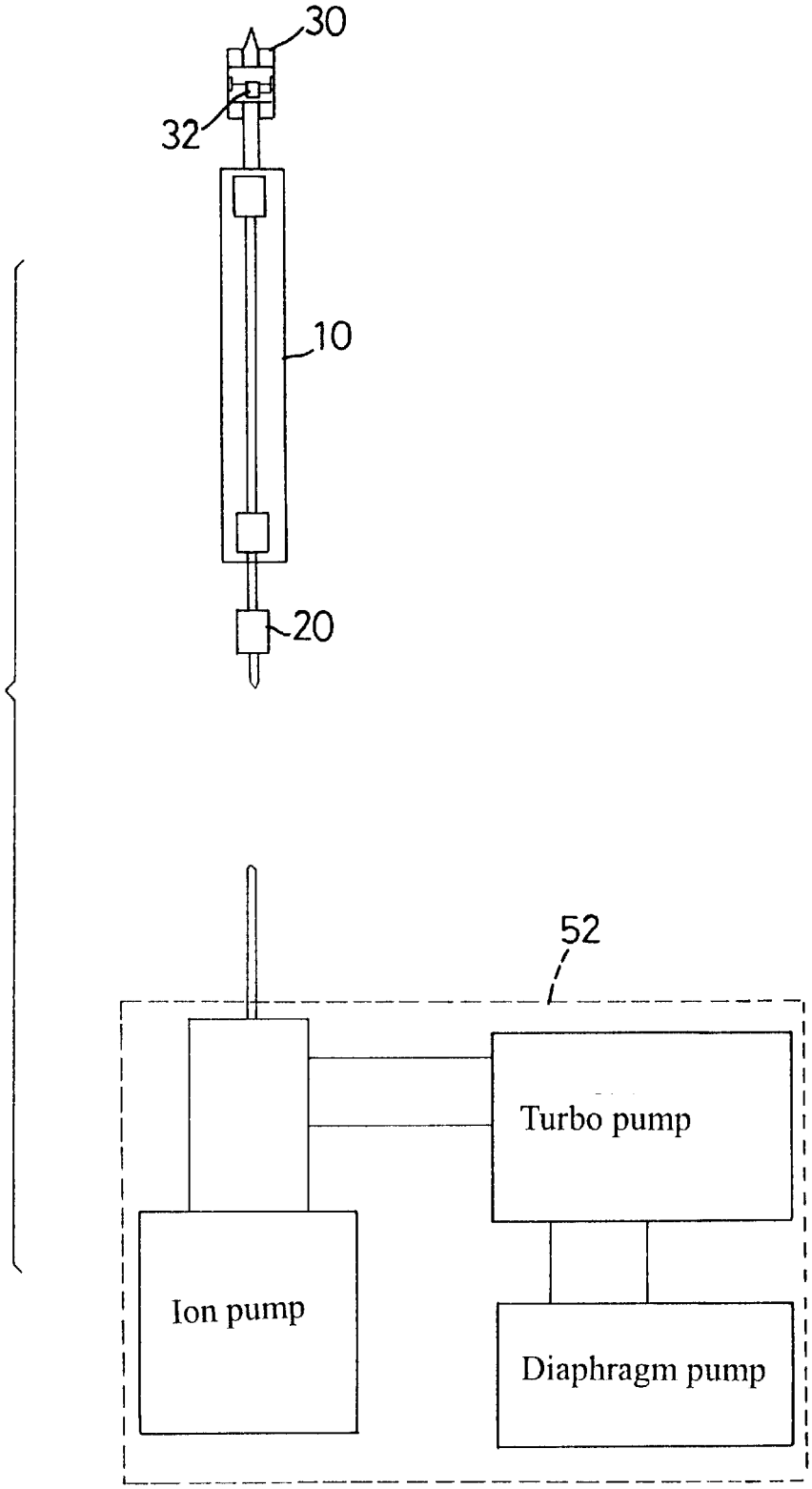
FIG. 10 is a schematic view of the microwave tube removed from the heating exhaust station to be prepared for aging.

Fourthly, with reference to FIG. 10, when the foregoing procedures are completed, the electric power source (40) is shut down, and the getter (32) is allowed to cool down to the room temperature. After cooling, the microwave tube (10) is removed from the heating exhaust station (50) and prepared for the aging process. At this moment, the getter (32) starts to absorb the air so as to create a substantial vacuum state in the microwave tube (10).

The aforementioned procedures relate to the exhaust process of the microwave tube (10), while after the exhaust process, the microwave tube (10) undergoes the aging process. During the aging process, the getter (32) is heated to 400° C. to accelerate the speed of the getter (32) absorbing the air. The required time under the specified conditions is as following:

1. DC aging (0%~11% duty)+RF aging (0%~11% duty): 10~20 hours;
2. RF aging (11% duty): 50 hours.

Therefore, total time required is less than 70 hours, and comparing the time required for the conventional suction device which is about 270 hours, it is obvious that the present invention greatly saves the time and cost associated with the production of the microwave tube.

It should be appreciated that the suction unit is reusable. After the getter (32) have undergone the aforementioned aging process, a replacement of the getter (32) to a new one is allowed so that the rest of the suction unit can be reused.

While this invention has been particularly shown and described with references to the preferred embodiments thereof, it will be understood by those skilled in the art that various changes in form and details may be made therein without departing from the scope of the invention encompassed by the appended claims.

What is claimed is:

1. A suction device used in aging process of a microwave tube having an electron gun and a collector respectively disposed in two opposite ends of the microwave tube, the suction device comprising:

an ion pump adapted to be connected to the electron gun;

a suction unit adapted to be connected to the collector, the suction unit having:

a barrel adapted to be communicated with the microwave tube; and a getter disposed inside the barrel to absorb air in the microwave tube; and an electric power source electrically connected to the getter.

2. The suction device as claimed in claim 1 further comprising two insulating rings mounted in the barrel, a conducting ring clamped between the insulating rings to electrically connect to the electric power source yet insulated from the barrel.

3. The suction device as claimed in claim 2, wherein the getter has two electrodes respectively and electrically connected to the barrel and the conducting ring.

4. The suction device as claimed in claim 1, wherein the barrel is composed of kovar.

5. The suction device as claimed in claim 2, wherein the barrel is composed of kovar.

6. The suction device as claimed in claim 2, wherein the insulating ring is composed of ceramics.

7. The suction device as claimed in claim 2, wherein the conducting ring is composed of kovar.

* * * * *